428-408 SR
1/11/77 XR 4,002,784

United States Patent [19]
Banker et al.
[11] 4,002,784
[45] Jan. 11, 1977

[54] COATING METHOD FOR GRAPHITE

[75] Inventors: John G. Banker, Kingston; Cressie E. Holcombe, Jr., Knoxville, both of Tenn.

[73] Assignee: The United States of America as represented by the United States Energy Research and Development Administration, Washington, D.C.

[22] Filed: Nov. 6, 1975

[21] Appl. No.: 629,245

[52] U.S. Cl. ..... 427/385 R; 427/133; 427/415; 428/408

[51] Int. Cl.[2] ..... B05D 7/22; B22C 3/00

[58] Field of Search ..... 427/133, 419, 415, 372 R, 427/380, 385 R, 419 A, 419 D; 106/38.22, 38.23; 428/408

[56] References Cited

UNITED STATES PATENTS

| | | | |
|---|---|---|---|
| 3,110,944 | 11/1963 | Phelps | 106/38.22 X |
| 3,180,632 | 4/1965 | Katz et al. | 427/133 X |
| 3,660,075 | 5/1972 | Harbur et al. | 75/65 R |

FOREIGN PATENTS OR APPLICATIONS

| | | | |
|---|---|---|---|
| 1,128,816 | 10/1968 | United Kingdom | 106/38.23 |
| 1,156,445 | 6/1969 | United Kingdom | 106/38.23 |

*Primary Examiner*—James R. Hoffman
*Attorney, Agent, or Firm*—Dean E. Carlson; David S. Zachry; Allen H. Uzzell

[57] ABSTRACT

A method of limiting carbon contamination from graphite ware used in induction melting of uranium alloys is provided comprising coating the graphite surface with a suspension of $Y_2O_3$ particles in water containing about 1.5 to 4% by weight sodium carboxymethylcellulose.

3 Claims, No Drawings

COATING METHOD FOR GRAPHITE

BACKGROUND OF THE INVENTION

This invention was made in the course of, or under, a contract with the Energy Research and Development Administration. It relates in general to the art of providing refractory coatings and more particularly to a coating composition containing $Y_2O_3$ which is effective for coating graphite ware to prevent carbon contamination during the melting and alloying of reactive metals.

In the nuclear industry, there exists an extensive need for high density shielding materials which may be easily fabricated, heat treated to a wide range of mechanical properties, and maintained chemically inert in nominally atmospheric conditions. Uranium metal is particularly useful for such applications, however, unalloyed uranium is highly susceptible to corrosion and exhibits anisotropic properties. Improved corrosion resistance may be attained by alloying uranium with various amounts of alloying metals such as molybdenum, vanadium, niobium, tungsten, and titanium. When alloyed in the proper proportions, the binary, ternary and quaternary alloys have improved corrosion resistance and possess more isotropic qualties. The improved properties are a result of the presence of a metastable gamma phase in quenched alloys. In order to control the properties of the alloy, the composition must be controlled within a very narrow range. Low temperature ageing of these gamma-stabilized uranium alloys can produce a wide range of yield strengths and elongations. For example, current studies have shown that the best combination of strength and corrosion resistance can be realized with alloys in the uranium-niobium-zirconium system and in particular with a uranium-16.6 atom percent niobium-5.6 atom zirconium alloy. It is essential that the composition of uranium alloys be controlled within a very narrow range in order to obtain the desired properties.

This requirement for strict composition control in uranium alloys has been the source of a very troublesome coating problem. Alloying metals which are reactive with carbon, such as molybdenum, niobium, zirconium, and titanium, have a strong tendency to react with graphite ware used in induction melting operations, forming carbides. These carbides float to the surface of the melt and cause the final alloy to be deficient in the reacted metals. Furthermore, uranium also can form carbides from graphite. In order to prevent this carbide formation with reactive metals, it is necessary that graphite ware (crucibles, stirrers, stoppers, etc.) be provided with a tough unreactive coating capable of withstanding the melting and alloying temperatures.

In order for a coating method to be effective for preventing carbon contamination from graphite ware during induction melting of uranium alloys, the coating must meet several requirements: it must be adherent and exhibit no cracking during application, drying, and heating; it must be sufficiently tough to withstand the impact of solid feed metals which are mechanically or manually fed into the crucible; the coating must be non-reactive with the molten metals and preferably not wet by them; and the coating must not react with the crucible and evolve contaminating gases such as CO and $CO_2$. Aside from these quality considerations, it is highly desirable that the coating composition have a long shelf life, be applicable in a routine manner, and require no thermal cure independent of the melting heat-up.

PRIOR ART

The art of providing high temperature coatings is an empirical science, particularly the art of coating graphite. Because graphite is unreactive at most process temperatures, adhesion in a coating is difficult to obtain. Those skilled in the art have been generally unable to predict whether an untried coating will withstand the process heating without cracking or separating from the graphite surface.

The art of coating graphite ware to prevent carbon contamination in inductively melted uranium alloys is complicated by the high process temperatures, usually greater than 1300° C and up to about 1600° C. Coatings of BeO, $BeSO_4$, $ZrSiO_4$, $MgZrO_4$, and $ZrO_2$ have been applied as aqueous slurries either by brush painting or air spraying. Adequate protection from carbon contamination can be obtained from this type of coating up to approximately 1300° C. Above this temperature these coatings begin to spall off and become ineffective due to excessive microcracking. A coating material of this type has been marketed by Tam Products Division of National Lead Company of Ohio under the name "Mold Wash B" and has the following composition by weight: 64.41% $MgZrO_3$, 0.65% sodium carboxymethylcellulose, 0.08% proprietary wetting agent, 9.95% sodium silicate solution (8.9% $Na_2O$, 28.7% $SiO_2$, and 62.4% $H_2O$) and 24.91% water. "Mold Wash B" was also effective on graphite only up to about 1300° C and had the additional disadvantage of causing excessive silicon contamination in uranium alloys.

For higher temperature applications, up to 1400° C, satisfactory protection was obtained by plasma sprayed coatings of zirconia stabilized by calcia, magnesia, or yttria, however above 1400° C these coatings deteriorate rapidly in contact with molten uranium. Protection at higher temperatures, up to 1550° C was afforded only with multiple layer plasma-sprayed coatings of niobium and zirconia, molybdenum and zirconia, or niobium, zirconia, and yttria.

While it is known in the art that $Y_2O_3$ is effective for preventing contamination of molten metals, a satisfactory method for coating graphite with $Y_2O_3$ has not been available. While plasma spraying $Y_2O_3$ will provide an effective coating, this method is expensive, cumbersome on an industrial scale, and requires specially trained personnel. The difficult problem of coating graphite with $Y_2O_3$ has been previously dealt with in commonly assigned U.S. Pat. No. 3,660,075 to Harbur et al. issued May 2, 1972. Harbur et al. recognized that the chief difficulty in coating was caused by a lack of adhesion between the $Y_2O_3$ and the graphite, and found that a $K_2SiO_3$ solution was an effective binder for holding $Y_2O_3$ to graphite. Unfortunately, this method caused silicon contamination which is in many alloys as serious a problem as carbon contamination. It is accordingly disclosed by Harbur et al. that during uranium melting in graphite ware, one has an unfortunate choice between carbon contamination from a Nb-C coated crucible and silicon contamination from a $Y_2O_3$ coated crucible.

In molten uranium alloys, any silica present is reduced by uranium, forming various silicides; $U_3Si$, $USi_2$, $USi_3$, etc. which appear as insoluble inclusions in the final alloy. When carbon contamination is also present in the molten metals, a $U_2Si_3C_2$ compound is formed.

The uranium in this carbide is readily replaceable by Nb, Zr, and Ti forming insoluble carbides and altering the alloy composition. The overall effect of silicon contamination in uranium alloys is excessive corrosion, embrittlement, and stress corrosion cracking. As seen, there has long been a need for a method of limiting carbon contamination during induction melting of uranium alloys that is inexpensive, effective above 1300° C, and introduces no silicon contamination to the alloys.

SUMMARY OF THE INVENTION

It is an object of this invention to provide a method of limiting adverse carbon contamination from graphite ware which is at least as effective as plasma-sprayed coatings and can be accomplished routinely by a manually applied coating. This and other objects which will be apparent to those skilled in the art are accomplished in a method of limiting adverse carbon contamination in metals from graphite ware used in melting said metals, said method comprising coating said graphite ware with a suspension comprising $Y_2O_3$ in an aqueous solution containing an effective suspending amount of sodium carboxymethylcellulose.

DETAILED DESCRIPTION

In an effort to develop a suitable method for providing a tough adhesive $Y_2O_3$ coating for graphite, several concepts were investigated. Slurries of $Y_2O_3$ in volatile organic liquids, e.g. EtOH, were found to result in powdery coatings which are easily scarred or damaged by contact with solid feed metals during loading. Aqueous mixtures of various suspending agents were tried. While a number of suspending agents were capable of suspending the $Y_2O_3$ particles in aqueous solution, only sodium carboxymethylcellulose (CMC) provided a suspension which could be applied to graphite like paint and withstand heating above 1300° C without cracking or separating from the graphite surface. Comparative tests have shown that by employing the coating method of this invention, the alloy composition can be maintained at least as well as with expensive plasma-sprayed $Y_2O_3$ coatings. CMC is a commercially available synthetic cellulose gum containing 0.4 to 1.5 sodium carboxy groups ($-CH_2COONa$) per glucose unit of the cellulose.

In order to make the coating composition of this invention all that is necessary is that the $Y_2O_3$ particles be suspended in an aqueous sodium carboxymethylcellulose (CMC) solution. An operable range of CMC concentration is about 1.5 to 4% by weight with respect to water. Below about 1.5% $Y_2O_3$ settles too rapidly and greater than about 4% provides an excessively viscous solution that is not easily workable. It has been found that a 3% aqueous CMC solution is the preferred concentration for suspending $Y_2O_3$ particles. The CMC requirement is therefore an effective suspending amount; that is an amount sufficient to suspend the particles.

The solid-to-liquid ratio may be varied as is well known to those skilled in the painting and coating arts in order to provide thicker or thinner coatings. It has been found as a preferred embodiment that the best results for limiting carbon contamination are obtained by applying multiple coats. The coating sequence which has yielded the greatest protection is sponging a first coat containing 35% by weight solids-65% by weight CMC solution followed by brushing a second coat containing 50% by weight solids and 50% by weight CMC solution. A third brushed coat of this 50—50 mixture will effectively eliminate practically all the carbon contamination. The first thin coat serves to penetrate the pores and crevices of the graphite and cause minute graphite particles to float to the surface. These particles are trapped in the first coat upon drying. The second thicker coat serves to effectively insulate these trapped particles from the molten metal. A third coat provides additional protection. It has been found that a solid-to-liquid weight ratio of from about 45:100 to about 60:100 is the preferred range for the first coat and a solid-to-liquid weight ratio of from about 90:100 to 110:100 is the preferred range for the second and successive coats. A 100:100 solids-to-liquid ratio produces a harder coating which sinters best upon heating than other compositions.

The preferred technique for making the coating composition results in a high quality coating with a minimum of dusting. The 3% by wt. aqueous CMC solution is made up and allowed to set for 3 to 5 days with periodic stirring. The proper weight of $Y_2O_3$ is added and the suspension slowly stirred, for example in a ball mill, for 48 hours. The resulting composition now has excellent paint-like properties and may be stored for months, requiring only agitation prior to use. A conventional paint shaker is suitable for this purpose.

The coating composition used in this invention is a suspension consisting essentially of $Y_2O_3$ in an aqueous suspending solution containing an effective suspending amount of sodium carboxymethlycellulose. While no other suspension agents have been found which will provide an effective $Y_2O_3$ coating for use above 1300° C, it is contemplated that scandium oxide and the oxides of the lanthanide series are substantial equivalents of $Y_2O_3$ in the subject process. Furthermore, to reduce costs, other oxides may be combined with the $Y_2O_3$ oxide, for example, weight ratio compositions such as $2Y_2O_3$-$ZrO_2$, $2Y_2O_3$-MgO, $2Y_2O_3$-CaO, $Y_2O_3$-$UO_2$, $2Y_2O_3$-$UO_2$ and $3Y_2O_3$-$UO_2$ are suspended in CMC solution and provide adequate coating for many applications.

The method of this invention is illustrated with respect to a uranium alloying system because of the high temperature used and the very demanding composition requirements. It should be apparent to those skilled in the art that this method will also be effective for preventing carbon uptake from graphite surfaces in a variety of applications especially the melting of metals which are reactive with carbon. The strict process requirements of uranium alloys make the subject method particularly useful and economical. Examples of uranium alloys for which this method is effective are presented in the following table.

TABLE

| Uranium Alloy (figures represent wt. %) | Maximum Temperature of Melting Operation (vacuum induction melting) | Time at Maximum Temperature |
|---|---|---|
| U - 2Nb | 1400° C | 30 min. |
| U - 6Nb | 1450° C | 30 min. |
| U - 7.5Nb -2.5Zr | 1500° C | 30 min. |

TABLE-continued

| Uranium Alloy (figures represent wt. %) | Maximum Temperature of Melting Operation (vacuum induction melting) | Time at Maximum Temperature |
|---|---|---|
| U - 0.75Ti | 1400° C | 30 min. |
| U - 10Mo | 1500° C | 30 min. |

In order to demonstrate the operability of the subject method for limiting carbon contamination the following example of a U-Nb alloy melting operation is presented.

EXAMPLE

Several liters of a coating composition were prepared by dispersing (stirring) 54 grams of $Y_2O_3$ powder per 100 ml. of aqueous sodium carboxymethylcellulose solution. This CMC solution was prepared by adding 3 grams of Standard Refined CMC (Wyndotte R-75-L, 95% active having an empirical formula of $Na_3C_{14}H_{17}O_{11}$) per 100 ml. of water. A second batch of coating composition was prepared in a like manner by dispersing 100 grams of $Y_2O_3$ powder per 100 ml. of the CMC solution.

The composition containing 54 grams of $Y_2O_3$ per 100 ml. was sponged over the surface of a bottom-pour, standard housing grade graphite crucible and graphite plug for use in an induction furnace. The coated graphite articles were dried at ambient conditions for 2 hours. The total thickness of the two coatings was about 0.005 in. An 825 kg. charge containing 550 kg. of uranium and 275 kg. of uranium-6 wt. % niobium alloy was loaded into the coated crucible and placed in an induction furnace. The charge was heated to 1400° C in a vacuum at 300° C/hr. and held at 1400° C for one half hour. The plug was removed from the bottom of the coated crucible and the molten metal drained into a graphite mold and cooled at about 200° C/hr. The alloy ingot was cooled and removed from the surface. The ingot was statistically sampled and analyzed for impurities, particularly carbon. Analyses showed a total carbon content of 50 ppm. prior to melting, indicating that only 20 ppm. of carbon was taken up during the melting operation. The analyses also showed that the alloyed ingot contained no impurities, including $Y_2O_3$, in excess of the content prior to alloying.

The function of the CMC solution during heat-up is not yet understood. While $K_2SiO_3$ and $Na_2SiO_3$ binders of the prior art melt around 900° C, these silicates do not decompose at melting temperatures, 1200°–1600° C, and remain in the coating as a liquid phase, binding the particles to the surface. It has been found that CMC in the coating decomposes to $Na_2O$, $H_2$, $H_2O$, CO, and $CO_2$ during heat up and eventually only $Na_2O$ (which is unreactive with most liquid metals) remains in the coating. The CMC has been observed to decompose above 200° C and the gases are evolved up to about 900° C during heat up. It is believed that somewhat uniform decomposition of the CMC over a broad temperature range during heat-up accounts for the absence of blistering and microcracking in the coating, and helps hold the $Y_2O_3$ particles together until sintering temperature is reached. It is believed that the $Na_2O$ which remains in the coating acts as a sintering aid to help the $Y_2O_3$ particles sinter to a rigid, less porous coating above about 1200° C. Upon sintering, the coating becomes bound to the graphite and does not crack upon further heating. The coating has been observed to withstand temperatures above 1500° C. Upon cool down, the sintered coating does not crack until below 1000° C. Even at a cooling rate of 300° C/hr. the cracking does not occur until 1000° C-well below the freezing point of molten uranium and uranium alloys and most transition metals, when the danger of carbon contamination is considerably lessened.

An aspect of this invention is the discovery that a suspension of $Y_2O_3$ in aqueous sodium carboxymethylcellulose solution, when applied to a graphite surface, results in a tough refractory coating which is capable of withstanding temperatures of in excess of 1500° C without cracking or separating from the graphite surface. It is particularly surprising, in view of prior experiences with suspended and slurry coatings on graphite, that the method of this invention was effective above 1300° C. While CMC was a component of the previously mentioned "Mold Wash B" it was not the principal suspending agent. A comparatively large amount of $Na_2SiO_3$, a known alloy contaminant, was necessary to form a satisfactory coating for molds used in casting molten metals. As mentioned earlier, a very valuable aspect of the present invention is the elimination of silicon-containing binders from the coating composition.

Another unobvious aspect of this invention is that the subject coating is effective for preventing carbon contamination even in thin coats as disclosed herein. This is advantageous in that $CO_2$ and CO which are evolved from the decomposing CMC are not present in sufficient quantity to cause significant carbon contamination. This invention is useful for coating ware made from any of the several grades of graphite in commercial use as well as the more expensive grades such as ATJ. The economy of application of the present coating method and its high effectiveness for preventing carbon contamination make it preferred over many other methods in wide use.

What is claimed is:

1. A method of limiting adverse carbon contamination in metals from graphite ware used in melting said metals, comprising coating said graphite ware with a suspension comprising $Y_2O_3$ in a suspending solution consisting of water and an effective suspending amount of sodium carboxymethylcellulose.

2. The method of claim 1 wherein said coating step is carried out by applying a first coat comprising 45–60 grams $Y_2O_3$ per 100 grams of said suspending solution, allowing said first coat to dry, and then applying a second coat comprising 90–110 grams of $Y_2O_3$ per 100 grams of suspending solution.

3. The method of claim 1 wherein said suspending solution consists of water and 1.5–4% by weight sodium carboxymethylcellulose.

* * * * *